US009153909B2

(12) United States Patent
Takatsu

(10) Patent No.: US 9,153,909 B2
(45) Date of Patent: Oct. 6, 2015

(54) LEVER-TYPE CONNECTOR

(75) Inventor: Masayoshi Takatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/371,498

(22) PCT Filed: Jul. 24, 2012

(86) PCT No.: PCT/JP2012/068659
§ 371 (c)(1),
(2), (4) Date: Jul. 10, 2014

(87) PCT Pub. No.: WO2013/105294
PCT Pub. Date: Jul. 18, 2013

(65) Prior Publication Data

US 2014/0349499 A1 Nov. 27, 2014

(30) Foreign Application Priority Data

Jan. 10, 2012 (JP) ..... 2012-001798

(51) Int. Cl.
*H01R 13/639* (2006.01)
*H01R 13/629* (2006.01)

(52) U.S. Cl.
CPC .... *H01R 13/62933* (2013.01); *H01R 13/62905* (2013.01)

(58) Field of Classification Search
CPC ..... H01R 13/62938; H01R 13/62955; H01R 13/639; H01R 13/62
See application file for complete search history.

(56) References Cited

U.S. PATENT DOCUMENTS

| | | | | |
|---|---|---|---|---|
| 5,888,080 | A | 3/1999 | Maejima | |
| 5,928,011 | A * | 7/1999 | Flask et al. | 439/157 |
| 5,928,013 | A | 7/1999 | Iwahori | |
| 6,210,185 | B1 | 4/2001 | Sakurai et al. | |
| 6,733,314 | B2 * | 5/2004 | Konda | 439/157 |
| 6,960,090 | B2 | 11/2005 | Denter et al. | |
| 7,520,764 | B2 * | 4/2009 | Lee et al. | 439/153 |
| 7,938,655 | B2 * | 5/2011 | Komiyama et al. | 439/157 |
| 8,007,298 | B2 * | 8/2011 | Komiyama et al. | 439/157 |
| 8,235,742 | B2 | 8/2012 | Komiyama et al. | |
| 2004/0002240 | A1 * | 1/2004 | Konda | 439/157 |

FOREIGN PATENT DOCUMENTS

| | | |
|---|---|---|
| EP | 0 940 885 | 9/1999 |
| JP | 6-54255 | 7/1994 |
| JP | 2004200071 | 7/2004 |
| JP | 2006302761 | 11/2006 |
| JP | 2008130288 | 6/2008 |
| JP | 2011175840 | 9/2011 |

OTHER PUBLICATIONS

International Search Report dated Oct. 30, 2012.

* cited by examiner

*Primary Examiner* — Gary Paumen
(74) *Attorney, Agent, or Firm* — Gerald E. Hespos; Michael J. Porco; Matthew T. Hespos

(57) ABSTRACT

A slide lever of a lever-type connector is a long plate-like member, inserted into a lever accommodation space of a main body side connector with a free longitudinal end thereof in the lead and arranged to be movable back and forth along an extending direction of the lever accommodation space. This slide lever includes a cam groove engageable with a cam pin projecting on a mating side connector. The cam groove includes an open end at an end surface of the slide lever extending in an inserting direction of the slide lever. A first path is connected to the open end portion and extends toward the free end with distance from the end surface. A second path extends away from the free end part with distance from the end surface and is connected to a deepest portion of the cam groove.

3 Claims, 12 Drawing Sheets

LEVER-TYPE CONNECTOR

BACKGROUND

1. Field of the Invention

The present invention relates to a lever-type connector.

2. Description of the Related Art

A connector provided with a lever for assisting connection (so-called "lever-type connector") is known as a connector as a component for connecting, for example, a wiring harness and a wiring harness or a wiring harness and various electric devices. As disclosed in Japanese Unexamined Patent Publication No. 2011-175840, Publication of Japanese Patent No. 4697125 and Publication of Japanese Patent No. 4448788, the lever-type connector is configured such that a slide lever is inserted into a lever accommodation space formed in a housing of one connector out of a pair of connectors to be connected to each other, a cam pin formed on a housing of the other connector is moved along a cam groove formed on the slide lever while the slide lever is displaced from an initial position to a connection position, whereby the pair of connectors can be connected.

A wiring harness to be wired in a vehicle is connected to a connector of a vehicle device in the vehicle in some cases by connecting a connector arranged on one end of the wiring harness to the connector of the vehicle device after wiring the wiring harness in the vehicle. In this mode, if the connector is of a lever type, a space for moving a slide lever has to be ensured in the vehicle. Thus, under circumstances of recent years where space-saving of the inside of a vehicle is required, a lever-type connector is necessary which requires a small space for moving a slide lever.

On the other hand, to sufficiently reduce an operation force of a slide lever and effectively assist the connection of connectors in a lever-type connector, a path of a cam groove is preferably inclined as moderately as possible with respect to an inserting direction of the slide lever. For example, if it is attempted to shorten a length of the cam groove in the inserting direction to reduce the space for moving the slide lever in the configurations disclosed in patent literatures 1 to 3, the path of the cam groove becomes steep, wherefore a larger force is necessary to operate the lever.

The present invention was developed in view of the above problem and aims to provide a technique capable of reducing a space for moving a slide lever while effectively assisting the connection of connectors.

SUMMARY OF THE INVENTION

A first aspect of the present invention is directed to a lever-type connector, including a main body side housing to which a mating side connector is connectable from a front end surface toward a rear end surface of the main body side housing and which is formed with a lever accommodation space extending in a direction perpendicular to a connecting direction, in which the mating side connector is connected, and forming an opening on a side end surface; a slide lever which is a long plate-like member, inserted into the lever accommodation space through the opening with one longitudinal end thereof as a leading end part in the lead and arranged to be movable back and forth along an extending direction of the lever accommodation space; wherein the slide lever includes a cam groove engageable with a cam pin projecting on the mating side connector; and the cam groove includes an open end portion open on an end surface of the slide lever extending in an inserting direction of the slide lever, a first path part connected to the open end portion and extending toward the leading end part with distance from the end surface, and a second path part extending away from the leading end part with distance from the end surface and connected to a deepest portion of the cam groove.

According to a second aspect, in the lever-type connector according to the first aspect, the open end portion of the cam groove is arranged on an axis passing through the deepest portion and perpendicular to the inserting direction.

According to a third aspect, the lever-type connector according to the first or second aspect further includes a return preventing portion which is capable of coming into contact with the cam pin so that the cam pin does not move back from the second path part to the first path part while allowing the cam pin to enter the second path part from the first path part.

According to a fourth aspect, in the lever-type connector according to any one of the first to third aspects, the first and second path parts face each other while being inclined at an equal angle with respect to the inserting direction in the opposite directions.

According to the first aspect, the cam groove includes the first path part extending toward the leading end part with distance from the end surface on which the open end portion of the cam groove is open, and the second path part extending away from the leading end part with distance from the end surface. According to this configuration, a length of the cam groove in the inserting direction of the slide lever can be made shorter without steeply inclining a path of the cam groove with respect to the inserting direction. Thus, it is possible to reduce the space for moving the slide lever while effectively assisting the connection of the connectors.

According to the second aspect, the open end portion of the cam groove is arranged on the axis passing through the deepest portion and perpendicular to the inserting direction. According to this configuration, a length along the cam groove becomes longer and the path of the cam groove with respect to the inserting direction of the slide lever can be sufficiently moderately inclined.

According to the third aspect, the cam pin is unlikely to move back from the second path part to the first path part. Thus, the cam pin is smoothly guided to the deepest portion of the cam groove.

According to the fourth aspect, the first and second path parts face each other while being inclined at the equal angle with respect to the inserting direction in the opposite directions. According to this configuration, a force necessary in each stage of displacing the slide lever is unlikely to vary.

An object, features, aspects and advantages of this invention will become more apparent upon reading the following detailed description along with the accompanying drawings.

DETAILED DESCRIPTION OF THE PREFERRED EMBODIMENTS

Hereinafter, an embodiment of the present invention is described with reference to the accompanying drawings. The following embodiment is one specific example of the present invention and not intended to limit the technical scope of the present invention.

<1. Configuration>

Figure 1:
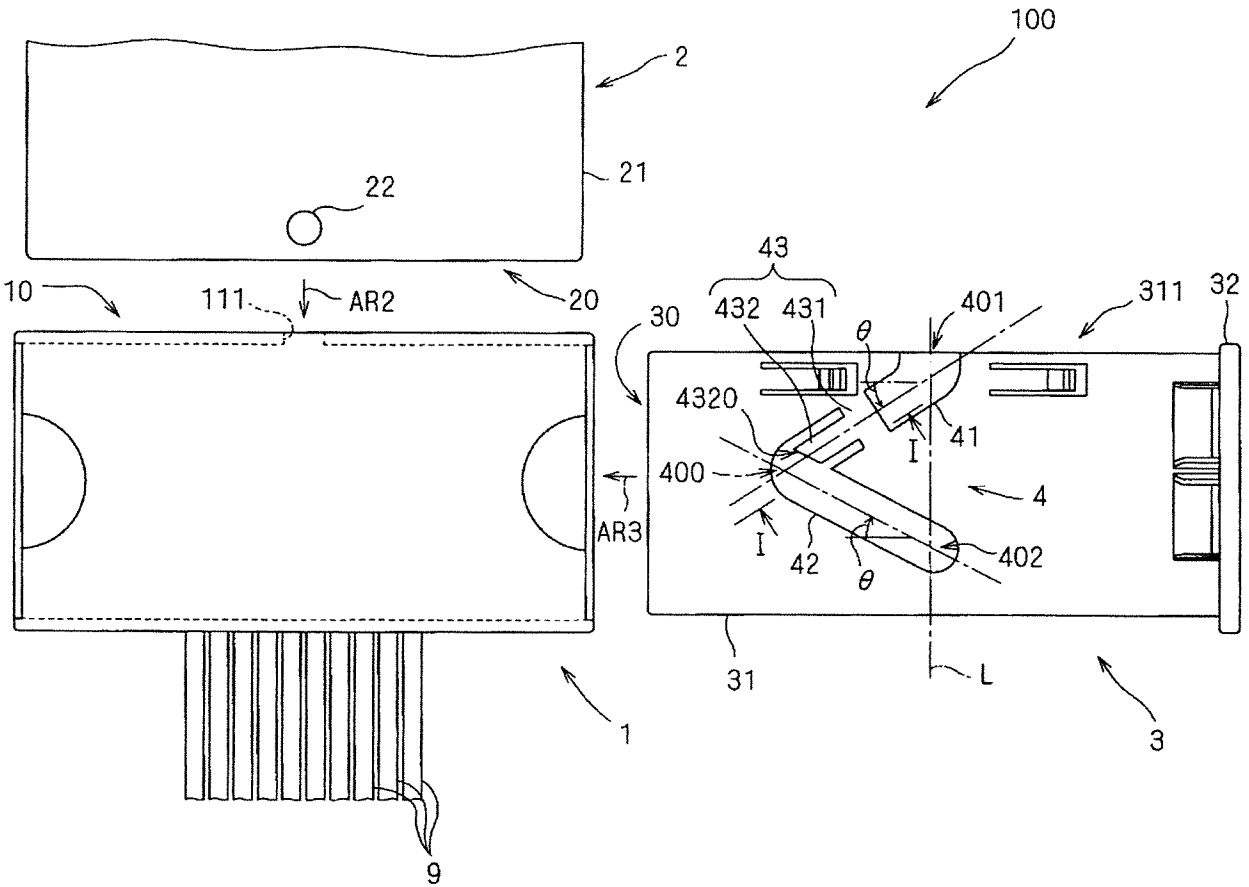
FIG. 1 is a schematic top view showing a main body side connector, a mating side connector and a slide lever in a state separated from each other.
Figure 2:
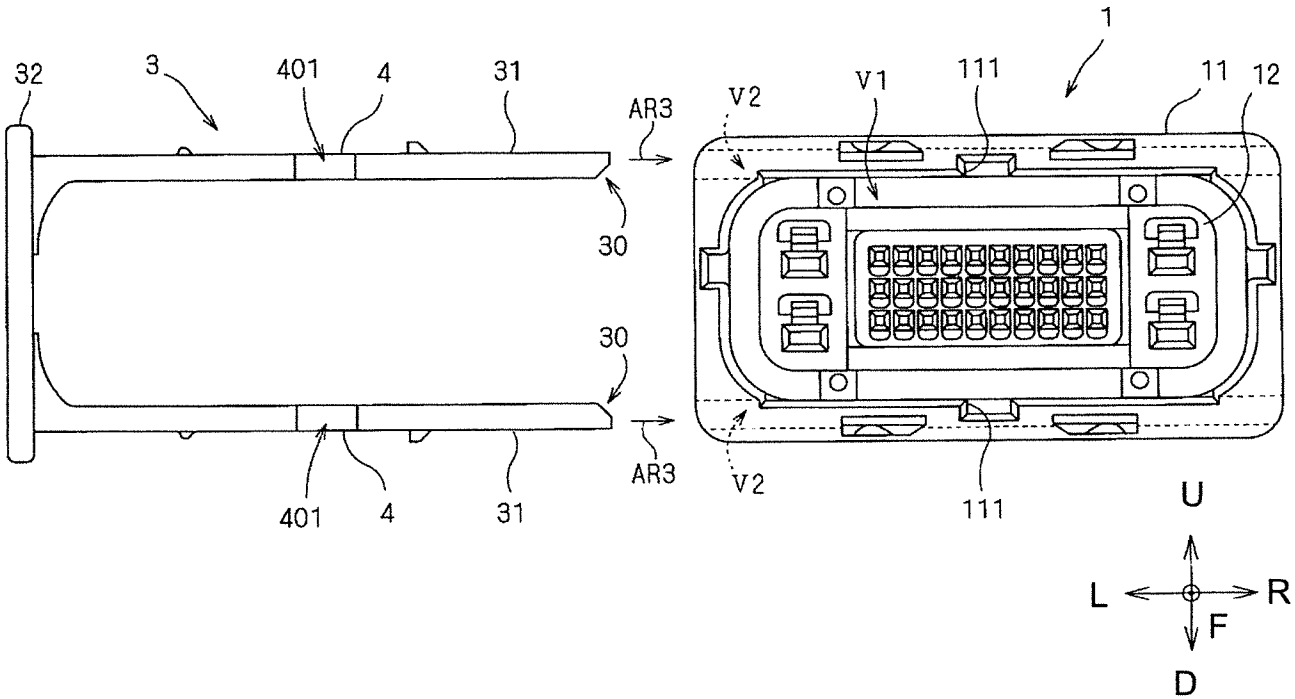
FIG. 2 is a schematic front view showing the main body side connector, the mating side connector and the slide lever in the state separated from each other.

The configuration of a lever-type connector 100 according to the embodiment is described with reference FIGS. 1 and 2. FIG. 1 is a schematic top view showing a main body side connector 1, a mating side connector 2 and a slide lever 3 in a state separated from each other. FIG. 2 is a schematic front view showing the main body side connector, the mating side connector and the slide lever in the state separated from each other.

The lever-type connector 100 is a component for connecting, for example, a wiring harness and a wiring harness or a wiring harness and various electric devices in a vehicle. The lever-type connector 100 is suitably used, for example, as a connector for multi-pole connection.

The lever-type connector 100 mainly includes a pair of connectors 1, 2 connectable to each other and the slide lever 3 for assisting the connection of the pair of connectors 1, 2. Here, for example, one connector 1 out of the pair of connectors 1, 2 is mounted on an end part of a wiring harness and the other connector is mounted on a vehicle device (not shown) to be connected to the wiring harness. The connector 1 to be mounted on the end part of the wiring harness is also referred to as the "main body side connector 1" and the connector 2 to be mounted on the vehicle device is also referred to as the "mating side connector 2" below.

<1-1. Mating Side Connector 2>

The mating side connector 2 is described with reference to FIG. 1. Note that, in the following description, the side of an open end surface 20 of the mating side connector 2 is also referred to as a front side. Further, directions in the mating side connector 2 corresponding to a vertical direction and a lateral direction of the main body side connector 1 are respectively also referred to as a vertical direction and a lateral direction.

The mating side connector 2 includes a receptacle 21 with one open end surface 20. Bar-like terminal fittings (male terminal fittings) 92 are arranged in a front-back direction in this receptacle 21 (see FIG. 11). The receptacle 21 is fitted into a receptacle accommodation space V1 of the main body side connector 1 with the open end surface 20 in the lead (arrow AR2). A cam pin 22 stands at a substantially center position in the lateral direction on each of upper and lower outer walls of the receptacle 21. The cam pins 22 are engaged with cam grooves 4 of the slide lever 3.

<1-2. Main Body Side Connector 1>

Figure 3:
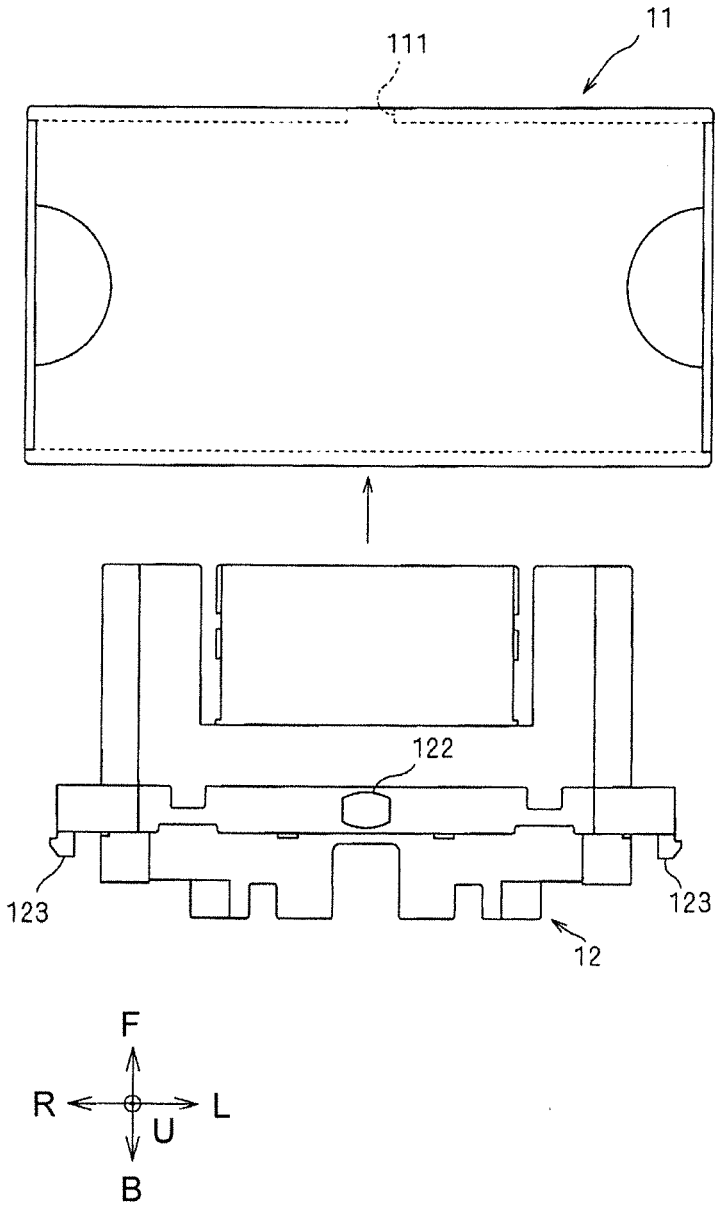
FIG. 3 is a schematic top view showing an outer housing and an inner housing before being assembled.
Figure 4:
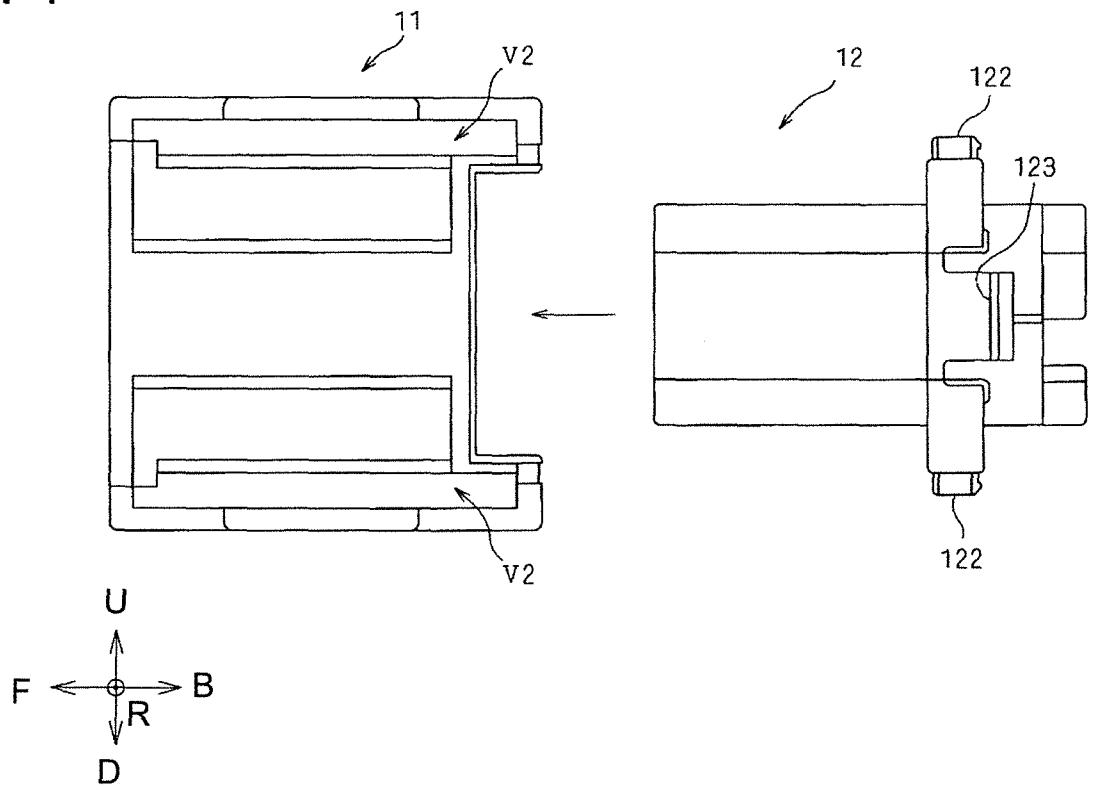
FIG. 4 is a schematic side view showing the outer housing and the inner housing before being assembled.

The main body side connector (main body side housing) 1 is described with reference to FIGS. 3 and 4 in addition to FIGS. 1 and 2. FIG. 3 is a schematic top view showing an outer housing 11 and an inner housing 12 before being assembled. FIG. 4 is a schematic side view showing the outer housing 11 and the inner housing 12 before being assembled. Note that, in the following description, the side of a surface (connection surface 10) of the main body side connector 1 to be connected to the mating side connector 2 is also referred to as a front side, and a direction (connecting direction) AR2 in which the mating side connector 2 is connected to the main body side connector 1 is also referred to as a front-back direction. Further, in a direction perpendicular to the front-back direction, sides in which a pair of lever accommodation spaces V2 are arranged with respect to the receptacle accommodation space V1 are also referred as upper and lower sides. Further, a direction perpendicular to the front-back direction and the vertical direction is also referred to as a lateral direction.

The main body side connector 1 is, for example, made of synthetic resin and includes the outer housing 11 substantially in the form of a box open in the front-back direction and the inner housing 12 to be accommodated in the outer housing 11.

Figure 11:
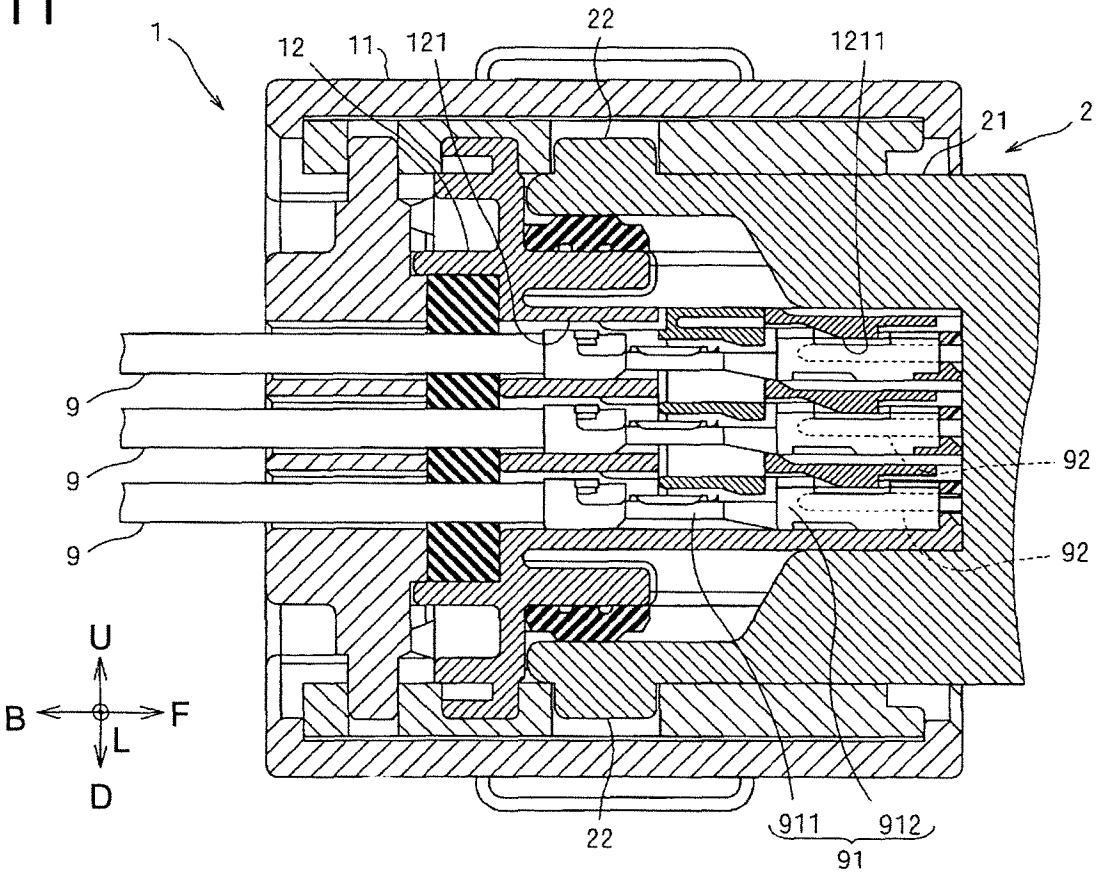
FIG. 11 is a schematic section along II-II of FIG. 10.

The inner housing 12 is formed with cavities 12 penetrating in the front-back direction (see FIG. 11). Female terminal fittings 91 connected to ends of wires 9 are accommodated in the cavities 121. Each female terminal fitting 91 is composed of a barrel portion 911 to be caulked to the wire 9 and a rectangular tube portion 912 formed before the barrel portion 911. By inserting the male terminal fitting 92 of the mating side connector 2 into this rectangular tube portion 912, the male and female terminal fittings 92, 91 are electrically connected. A locking lance 1211 cantilevered forward is formed in an inner side wall of the cavity 121, and the rectangular tube portion 912 is locked by this locking lance 1211, whereby the female terminal fitting 91 is retained.

The inner housing 12 is inserted into an inner space of the outer housing 11 through a rear open surface of the outer housing 11, and fixedly held in the outer housing 11 (assembled state) by projections projecting on the outer peripheral surface of the inner housing 12 (e.g. projections 122, 122 projecting at positions near the rear end on upper and lower outer surfaces of the inner housing 12 and projections 123, 123 projecting at positions near the rear end on left and right outer surfaces of the inner housing 12) being caught by locking grooves, locking holes or the like (not shown) provided on an inner peripheral edge part of the outer housing 11. By assembling the inner and outer housings 12, 11, the main body side connector 1 is formed.

The mating side connector 2 is connectable to the main body side connector 1 from the front end surface (connection surface 10) toward the rear end surface of the main body side connector 1. Specifically, in the assembled state, the space V1 open forward and extending in the front-back direction is formed between the inner peripheral surface of the outer housing 11 and the outer peripheral surface of the inner housing 12 when viewed from a front open surface of the outer housing 11, and the receptacle 21 of the mating side connector 2 is insertable into this space V1. This space V1 is also referred to as the "receptacle accommodation space V1" below. By inserting the receptacle 21 of the mating side connector 2 into the receptacle accommodation space V1 through the connection surface 10, the main body side connector 1 and the mating side connector 2 are connected.

Further, in the assembled state, the spaces V2 penetrating in the lateral direction are formed between the upper wall of the outer housing 11 and that of the inner housing 12 and between the lower wall of the outer housing 11 and that of the inner housing 12. That is, the spaces V2 extending in the lateral direction (i.e. direction perpendicular to the connecting direction AR2) and open on the left and right end surfaces of the main body side connector 1 are formed in upper and lower sides of the main body side connector 1. Sliding plates 31 of the slide lever 3 to be described later can be accommodated into these spaces V2. These spaces V2 are also referred to as the "lever accommodation spaces V2" below.

A groove 111 is formed at a lateral center position of each of the upper and lower end edges of an opening formed in the front end surface of the outer housing 11. The grooves 111 function as insertion grooves for allowing the insertion of the pair of cam pins 22 formed on the receptacle 21 into the lever accommodation spaces V2 when the receptacle 21 of the mating side connector 2 is inserted into the receptacle accommodation space V1.

<1-3. Slide Lever 3>

The slide lever 3 is described again with reference to FIGS. 1 and 2. The slide lever 3 is, for example, made of synthetic resin and formed into a gate shape in which base ends of a pair of sliding plates 31, 31 are coupled by an operating portion 32.

The operating portion 32 functions as a coupling portion coupling the pair of sliding plates 31, 31 and as a grip portion in accommodating the pair of sliding plates 31, 31 into the lever accommodation spaces V2. That is, an operator can move the pair of sliding plates 31, 31 back and forth into and from the lever accommodation spaces V2 by gripping the operating portion 32.

Each sliding plate 31 is a long plate-like member and one longitudinal end part thereof is attached to the operating portion 32. Each sliding plate 31 is so formed that a length thereof in the longitudinal direction is substantially equal to a length of the lever accommodation space V2 in an extending direction, and arranged to be movable back and forth in the extending direction of the lever accommodation space V2 by being inserted into the lever accommodation space V2 with another longitudinal end part (free end part) 30 in the lead. That is, the free end parts 30 of the sliding plates 31 are leading end parts when the slide lever 3 is inserted into the lever accommodation spaces V2. Further, the cam grooves 4 are formed at positions of the pair of sliding plates 31, 31 facing each other.

The cam groove 4 is in the form of a groove vertically penetrating through the sliding plate 31, and a width thereof is so set that the cam pin 22 provided on the mating side connector 2 is engageable with the cam groove 4 (specifically, slightly larger than an outer diameter of the cam pin 22). The cam groove 4 includes an open end portion 401 open on an end surface of the sliding plate 31 (i.e. end surface to be arranged on the side of the connecting surface 10 of the main body side connector 1 out of a pair of end surfaces extending in an inserting direction (arrow AR3) in inserting the slide lever 3 into the lever accommodation spaces V2) and a path part extending from the open end portion 401 to a deepest portion 402.

The path part includes a first path part 41 and a second path part 42. The first path part 41 is connected to the open end portion 401 on one end, extends in a direction toward the free end part 30 with distance from the end surface 311 and is connected to the second path part 42 on the other end. On the other hand, the second path part 42 is connected to the first path part 41 at one end, extends in a direction away from the free end part 30 with distance from the end surface 311 and is connected to the deepest portion 402 on the other end. A bent part between the first and second path parts 41, 42 is also referred to as a "bent portion 400" below.

The deepest portion 402 is arranged at a center position in the inserting direction AR3 of the sliding plate 31. Here, the open end portion 401 is arranged on an axis L passing through the deepest portion 402 and perpendicular to the inserting direction AR3 (i.e. an axis parallel to the connecting direction AR2) (axis L is a virtual axis). That is, the open end portion 401 is open at a center position of the end surface 311 in the inserting direction AR3.

Further, the first and second path parts 41, 42 face each other while being inclined at an equal angle with respect to the inserting direction AR3 in opposite directions. That is, if an extending direction of the first path part 41 is inclined counterclockwise by an angle θ with respect to the inserting direction AR3 of the slide lever 3, an extending direction of the second path part 42 is inclined clockwise by the angle θ with respect to the inserting direction AR3.

Figure 5:
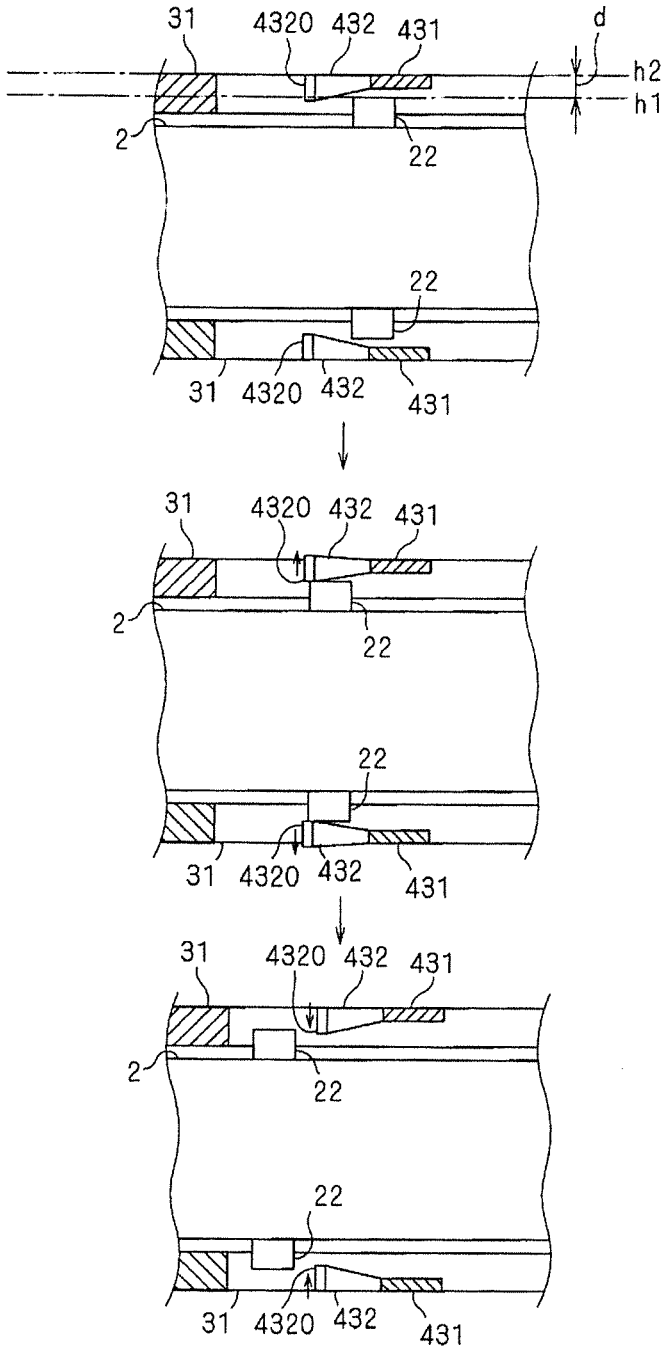
FIG. 5 is a diagram showing the configuration of a return preventing portion.

A return preventing portion 43 is formed in the first path part 41. The return preventing portion 43 is formed to be able to come into contact with the cam pin 22 so that the cam pin 22 does not move back from the second path part 42 to the first path part 41 while allowing the cam pin 22 to move from the first path part 41 to the second path part 42. Here, a configuration example of the return preventing portion 43 is described with reference to FIG. 5 in addition to FIG. 1. FIG. 5 is a schematic section along I-I of FIG. 1 showing a state where the cam pins 22 pass through the vicinities of the return preventing portions 43.

The return preventing portion 43 includes a bridging portion 431 and a locking piece 432.

The bridging portion 431 is formed to cross over the cam groove 4 in a width direction at a predetermined position of the first path part 41. The bridging portion 431 is formed to be sufficiently thin so as not to hinder the passage of the cam pin 22 through the first path part 41. Specifically, the bridging portion 431 is so arranged that an outer side surface thereof is flush with an outer side surface h2 of the sliding plate 31 and so formed that a thickness thereof is sufficiently smaller than a separation distance d between a plane on which the upper end surface of the cam pin 22 passes (passage plane h1) and the outer side surface h2 of the sliding plate 31.

The locking piece 432 is attached to the bridging portion 431 on one end and extends along the first path part 41 and the other end surface (free end surface 4320) thereof faces the second path part 42. Further, the locking piece 432 is shaped to be gradually thicker from the attached end toward a free end, and a thickness of the free end surface 4320 is larger than the separation distance d. Here, the locking piece 432 is pivotable in a direction perpendicular to an extending direction thereof. In a natural state, an outer side surface of the locking piece 432 is flush with the outer side surface h2 of the sliding plate 31 so that at least a part of the end surface 4320 projects further downward than the passage plane h1. This projecting part of the end surface 4320 functions as a contact surface which prevents the cam pin 22 from entering the first path part 41 by coming into contact with the cam pin 22 trying to move back from the second path part 42 to the first path part 41 and guides the cam pin 22 to the second path part 42.

In the return preventing portion 43 according to the above configuration, when the cam pin 22 moving from the open end portion 401 toward the bent portion 400 in the first path part 41 reaches the vicinity of the free end of the locking piece 432, the locking piece 432 pivots laterally outward to allow the cam pin 22 to enter the second path part 42 as shown in FIG. 5. After the passage of the cam pin 22, the locking piece 432 is returned to the natural state again. On the other hand, if the cam pin 22 having entered the second path part 42 from the first path part 41 moves back and tries to return to the first path part 41 again, at least a part of the end surface 4320 of the locking piece 432 comes into contact with a side surface of the cam pin 22 to prevent the cam pin 22 from entering the first path part 41 and guide the cam pin 22 to the second path part 42.

<2. Connection Mode>

Figure 10:
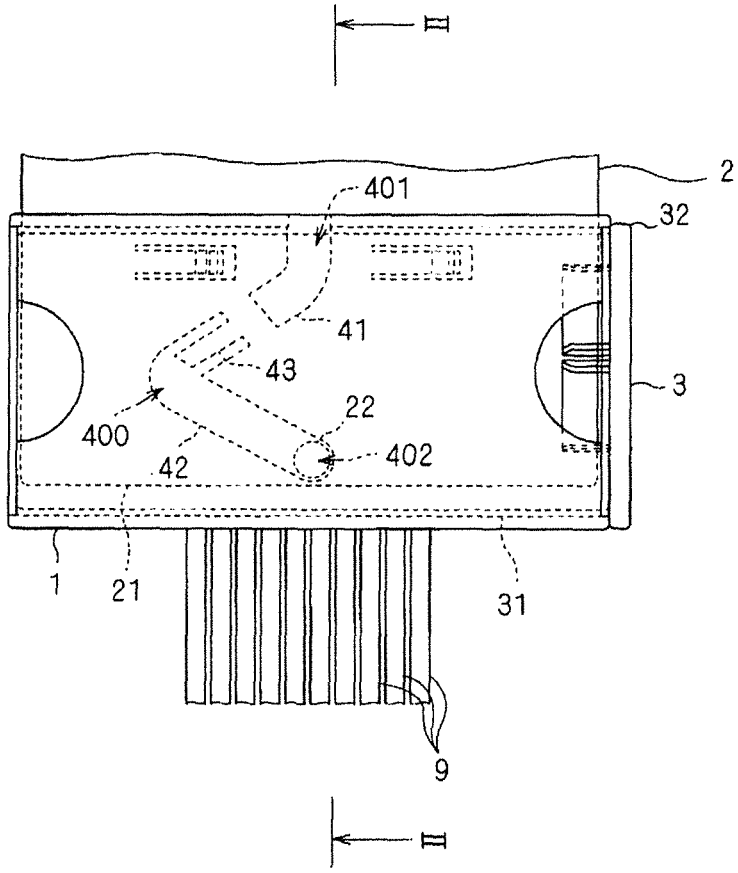
FIG. 10 is a schematic top view showing the main body side connector and the mating side connector while being connected and the slide lever

A connection mode of the main body side connector 1 and the mating side connector 2 is described with reference to FIGS. 6 to 11. FIGS. 6 to 9 are schematic top views showing the main body side connector 1 and the mating side connector 2 in each stage while being connected and the slide lever 3. FIG. 10 is a schematic top view showing the main body side connector 1 and the mating side connector 2 in a connected state and the slide lever 3. FIG. 11 is a schematic section along II-II of FIG. 10.

Prior to the following operation, the female terminal fittings 91 accommodated in the main body side connector 1 are connected to the wires 9 and the wires 9 are drawn to outside through a rear side of the main body side connector 1.

First, the pair of sliding plates 31, 31 of the slide lever 3 are respectively accommodated into the lever accommodation spaces V2 formed in the upper and lower sides of the main body side connector 1. Specifically, each sliding plate 31 is inserted in the inserting direction AR3 with the free end part 30 thereof in the lead through the open end of each lever accommodation space V2, and the groove 111 formed on the connection surface 10 of the main body side connector 1 and the open end portion 401 open on the end surface 311 of the sliding plate 31 are arranged at the same position in the lateral direction. As described above, in this embodiment, the groove 111 is formed at the lateral center position of the outer housing 11 and the open end portion 401 is also formed at the center position of the end surface 311 of the slide lever 3 in the inserting direction AR3. Thus, each sliding plate 31 is entirely accommodated into the lever accommodation space V2 and the operating portion 32 comes into contact with the open ends of the lever accommodation spaces V2, whereby the groove 111 and the open end portion 401 can be arranged at the same position in the lateral direction (state shown in FIG. 6). In this state, the inside of the cam groove 4 communicates with the connection surface 10 of the main body side connector 1 via the groove 111 and the open end portion 401.

Figure 6:
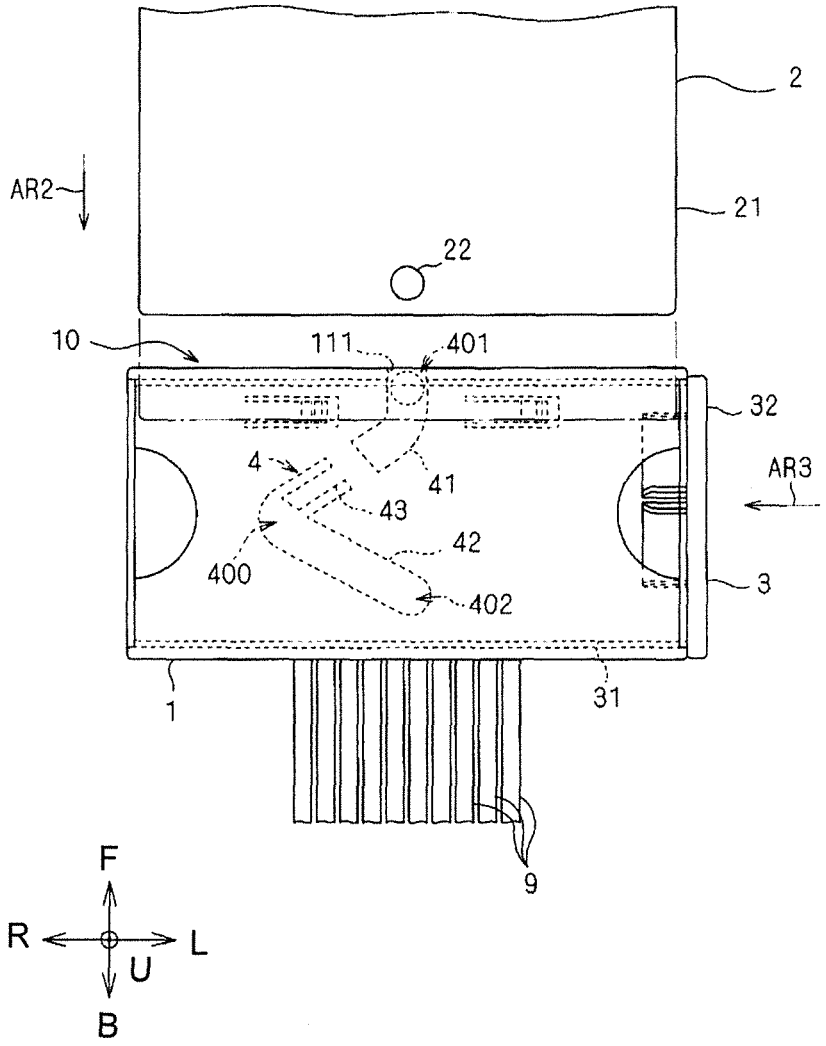
FIG. 6 is a schematic top view showing the main body side connector and the mating side connector while being connected and the slide lever.

Subsequently, the receptacle 21 of the mating side connector 2 is inserted in the connecting direction AR2 through the open end of the receptacle accommodation space V1 (see FIG. 2) open in the connection surface 10 of the main body side connector 1 and the cam pins 22 are arranged in the open end portions 401 of the cam grooves 4 by way of the grooves 111 (state shown in imaginary line of FIG. 6).

Subsequently, each sliding plate 31 entirely accommodated in the lever accommodation space V2 is pulled out from the lever accommodation space V2 (arrow AR4). Then, the cam pin 22 is guided from the open end portion 401 toward the bent portion 400 along the first path part 41 of the cam groove 4 and, associated with this, the mating side connector 2 moves in the connecting direction AR2 (state shown in FIG. 7). When the sliding plate 31 is pulled by a distance T and the cam pin 22 reaches the bent portion 400, the sliding plate 31 cannot be pulled out from the lever accommodation space V2 any more (state shown in FIG. 8). This distance T is equal to a separation distance $T_0$ between the open end portion 401 and the bent portion 400 in the inserting direction AR3.

Subsequently, each sliding plate 31 is pushed in the inserting direction this time (arrow AR3). Then, the cam pin 22 is guided from the bent portion 400 to the deepest portion 402 along the second path part 42 of the cam groove 4 and, associated with this, the mating side connector 2 further moves in the connecting direction AR2 (state shown in FIG. 9). When the entire sliding plate 31 is accommodated into the lever accommodation space V2, the cam pin 22 reaches the deepest portion 402 (states shown in FIGS. 10 and 11).

Figure 7:
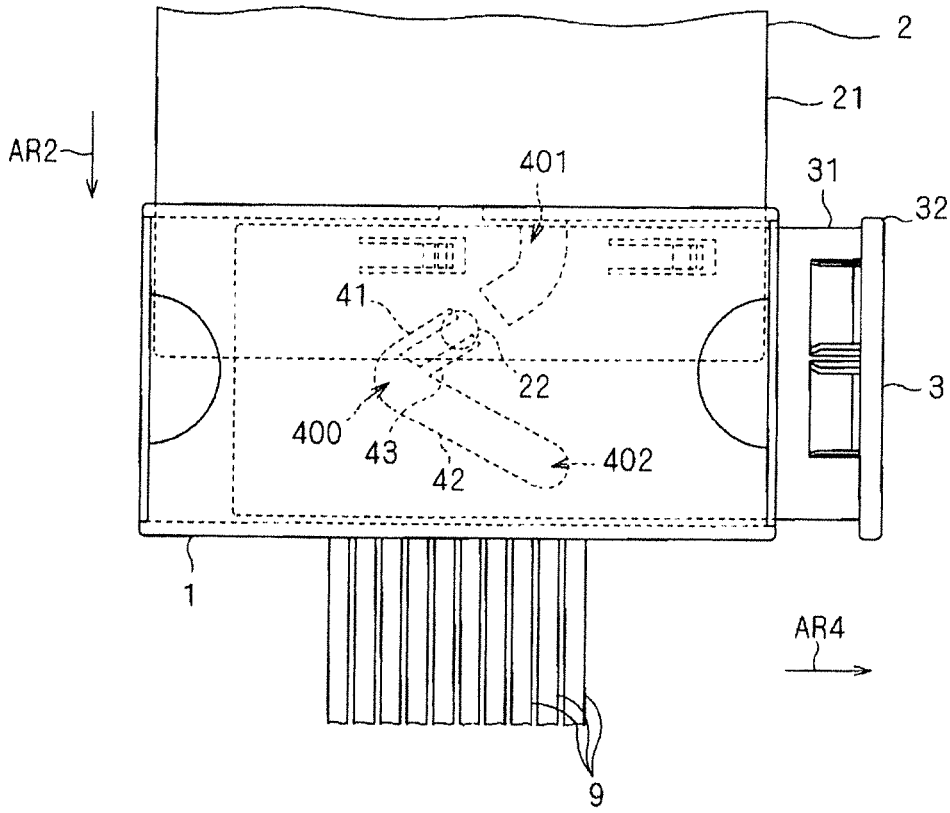
FIG. 7 is a schematic top view showing the main body side connector and the mating side connector while being connected and the slide lever.
Figure 8:
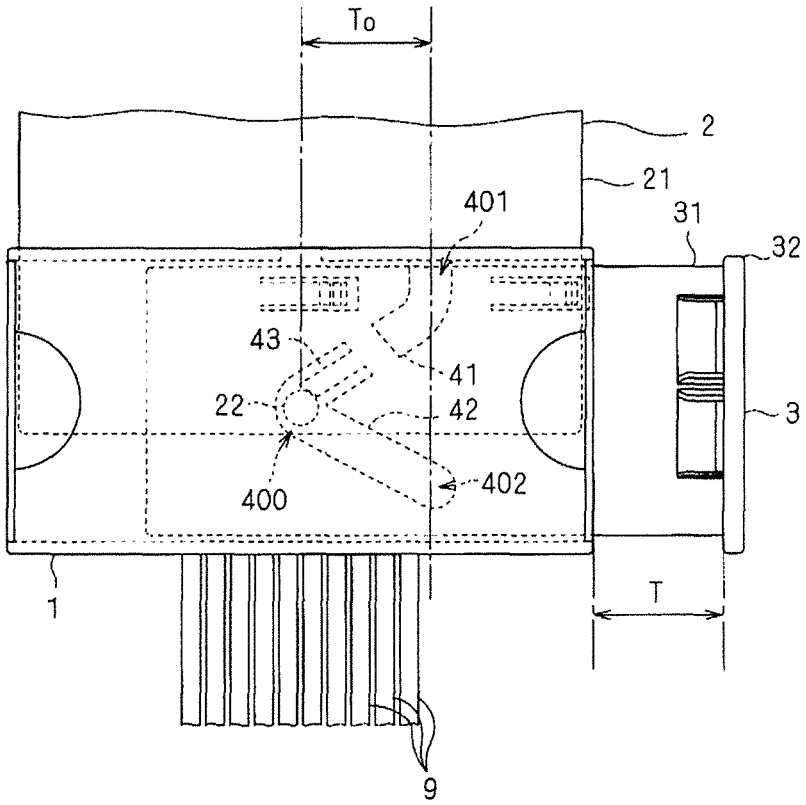
FIG. 8 is a schematic top view showing the main body side connector and the mating side connector while being connected and the slide lever.
Figure 9:
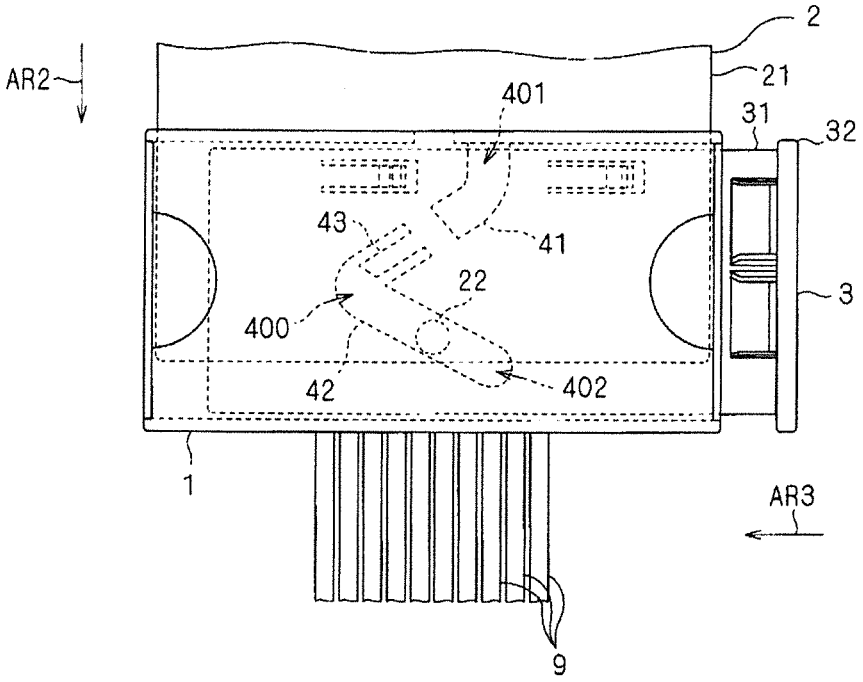
FIG. 9 is a schematic top view showing the main body side connector and the mating side connector while being connected and the slide lever.

As described above, when the cam pin 22 moving from the open end portion 401 toward the bent portion 400 in the first path part 41 reaches the vicinity of the free end of the locking piece 432 of the return preventing portion 43, the locking piece 432 pivots laterally outward to allow the cam pin 22 to enter the second path part 42 (see FIGS. 5 and 7). Further, after the cam pin 22 enters the second path part 42 from the first path part 41, the locking piece 432 is returned to the natural state again to prevent the cam pin 22 from entering the first path part 41 by at least the part of the end surface 4320 of the locking piece 321 coming into contact with the side surface of the cam pin 22 if the cam pin 22 having entered the second path part 42 moves back and tries to return to the first path part 41 again, and to guide the cam pin cam pin 22 to the second path part 42 (see FIGS. 5 and 8). Thus, a situation where the cam pin 22 moves back to enter the first path part 41 again when the sliding plate 31 pulled out halfway is pushed into the lever accommodation space V2 again is unlikely to occur.

As shown in FIGS. 7 to 10, as the cam pin 22 is guided from the open end portion 401 to the deepest portion 402 along the cam groove 4, the mating side connector 2 moves in the connecting direction AR2 with respect to the main body side connector 1. Then, the receptacle 21 of the mating side connector 2 is inserted deep into the receptacle accommodation space V1 of the main body side connector 1 in the connecting direction AR2 and the male terminal fittings 92 are inserted deep into the rectangular tube portions 912 of the female terminal fittings 91. When the cam pin 22 reaches the deepest portion 402, the main body side connector 1 and the mating side connector 2 are completely connected. Specifically, as shown in FIG. 11, the male terminal fittings 92 are sufficiently inserted into the rectangular tube portions 912 of the female terminal fittings 91 and the terminals 91, 92 are electrically connected.

As described above, the connection of the main body side connector 1 and the mating side connector 2 is achieved by moving the slide lever 3 back and forth in the lever accommodation spaces V2. Here, the maximum pull-out distance T of the slide lever 3 from the lever accommodation spaces V2 is equal to the length of the cam groove 4 in the inserting direction AR3 (i.e. separation distance between a part of the cam groove 4 closest to the free end part 30 and a part thereof closest to the operating portion 32 in the inserting direction AR3). Since the open end portion 401 and the deepest portion 402 are arranged on the same axis L perpendicular to the inserting direction AR3 in this embodiment, this distance T is equal to the separation distance $T_0$ between this axis L and the bent portion 400 in the inserting direction AR3 (i.e. separation distance $T_0$ between the open end portion 401 and the bent portion 400 in the inserting direction AR3). Thus, a space necessary to move the slide lever 3 has a length equivalent to this separation distance $T_0$ plus an operation space necessary to insert and pull out the slide lever 3 according to need.

Note that in the case of separating the once connected main body side connector 1 and mating side connector 2, a series of operations opposite to the above series of operations may be performed. Specifically, each sliding plate 31 entirely accommodated in the lever accommodation space V2 may be pulled out from the lever accommodation space V2, the cam pin 22 may be guided from the deepest portion 402 toward the bent portion 400 along the second path part 42 of the cam groove 4 and, subsequently, the sliding plate 31 partly pulled out from the lever accommodation space V2 may be pushed into the lever accommodation space V2 to guide the cam pin 22 from the bent portion 400 toward the open end portion 401 along the first path part 41 of the cam groove 4. However, in allowing the cam pin 22 to enter the first path part 41 from the second path part 42, the locking piece 432 needs to be caused to pivot laterally outward using a tool or the like and the cam pin 22 needs to enter the first path part 41 in this state.

<3. Effects>

According to the above embodiment, the cam groove 4 includes the first path part 41 extending toward the free end part 30 with distance from the end surface 311 on which the open end portion 401 is open, and the second path part 42 extending away from the free end part 30 with distance from the end surface 311. According to this configuration, the length of the cam groove 4 in the inserting direction AR3 can be made shorter without steeply inclining the path of the cam groove 4 with respect to the inserting direction AR3 of the slide lever 3. Thus, it is possible to reduce the space for moving the slide lever 3 while effectively assisting the connection of the connectors 1, 2.

Further, according to the above embodiment, the open end portion 401 of the cam groove 4 is arranged on the axis L passing through the deepest portion 402 and perpendicular to the inserting direction AR3. According to this configuration, a length (distance) along the cam groove 4 becomes longer and the path of the cam groove 4 with respect to the inserting direction AR3 of the slide lever 3 can be sufficiently moderately inclined.

Further, according to the above embodiment, the cam pin 22 is unlikely to move back from the second path part 42 to the first path part 41 by providing the return preventing portion 43. Thus, the cam pin 22 is smoothly guided to the deepest portion 402 of the cam groove 4.

Further, according to the above embodiment, the first and second path parts 41, 42 face each other while being inclined at the equal angle with respect to the inserting direction AR3 in the opposite directions. According to this configuration, a displacement amount of the slide lever 3 (displacement amount in the inserting direction AR3) and a displacement amount of the cam pin 22 (displacement amount in the connecting direction AR2) are equal when the cam pin 22 is passing in the first path part 41 and when the cam pin 22 is passing in the second path part 42. Therefore, a force necessary in each stage of displacing the slide lever 3 is unlikely to vary.

<4. Modification>

<4-1. Modification according to Return Preventing Portion>

Figure 12:
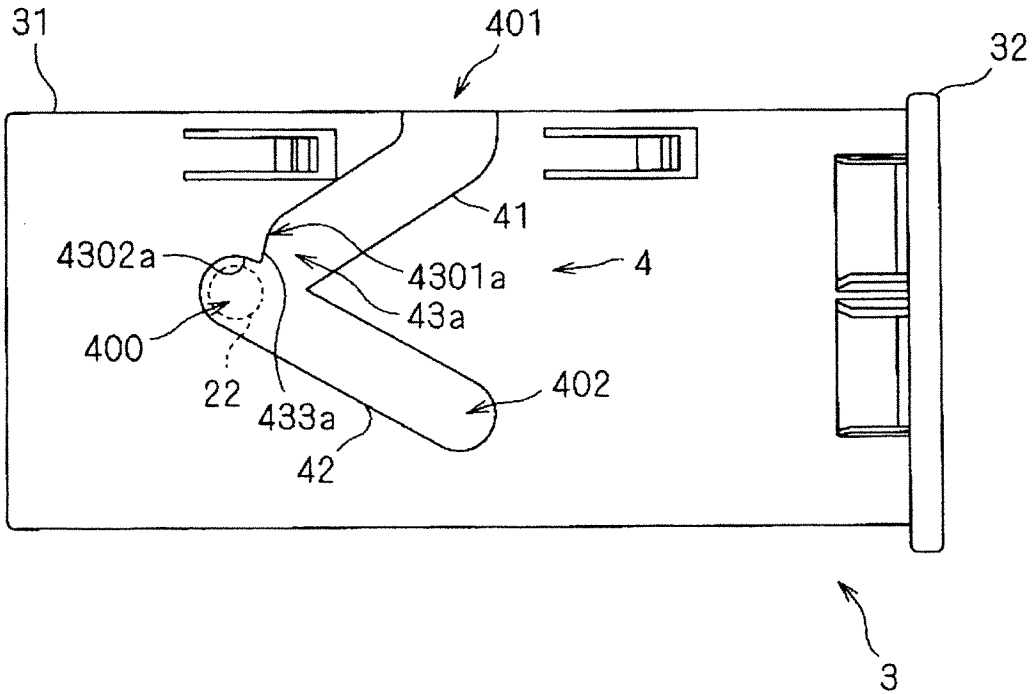
FIG. 12 is a schematic top view showing a slide lever according to a modification.

Although the return preventing portion 43 according to the above embodiment includes the bridging portion 431 and the locking piece 432, the configuration of the return preventing portion is not necessarily limited to this. FIG. 12 shows a return preventing portion 43*a* according to another configuration example. Note that, in the following description, components similar to those of the above embodiment are denoted by the same reference signs and not described.

The return preventing portion 43*a* shown here includes a bulging part 433*a* formed to bulge out in a direction intersecting with the width direction of the first path part 41 near the end part of the first path part 41 on the side of the bent portion 400. By forming the bulging part 433*a*, a constricted part is formed near the end part of the first path part 41. The constricted part of the first path part 41 is formed to have a width slightly larger than the diameter of the cam pin 22.

The bulging part 433*a* is formed into a substantially triangular plan shape narrowed toward a tip and has a first end surface 4301*a* forming a part of a side wall of the first path part 41 and a second end surface 4302*a* facing the second path part 42. Here, an angle between the second end surface 4302*a* and the extending direction of the first path part 41 is larger than an angle between the first end surface 4301*a* and this extending direction. Further, the bulging part 433*a* is so formed that at least a thickness of a part near the second end surface 4302*a* is larger than the separation distance d. In this modification, the second end surface 4302*a* functions as a contact surface which comes into contact with the cam pin 22 trying to move back from the second path part 42 to the first path part 41 to prevent the cam pin 22 from entering the first path part 41 and guides the cam pin 22 to the second path part 42. Further, the first end surface 4301*a* functions as a guiding surface which guides the cam pin 22 moving from the open end portion 401 toward the bent portion 400 in the first path part 41 to the bent portion 400.

In the return preventing portion 43*a* according to the above configuration, when the cam pin 22 moving from the open end portion 401 toward the bent portion 400 in the first path part 41 reaches the vicinity of the bulging part 433*a*, the cam pin 22 is guided by the first end surface 4301*a* to enter the second path part 42 while moving over the bulging part 433*a*. On the other hand, if the cam pin 22 having entered the second path part 42 from the first path part 41 moves back and tries to return to the first path part 41 again, the second end surface 4302*a* comes into contact with the side surface of the cam pin 22 to prevent the cam pin 22 from entering the first path part 41 and guide the cam pin 22 to the second path part 42.

Note that in the case of separating the once connected main body side connector 1 and mating side connector 2, the cam pin 22 may be caused to move over the bulging part 433*a* and enter the first path part 41 using a tool or the like in moving the cam pin 22 from the second path part 42 to the first path part 41.

<4-2. Other Modifications>

Although the open end portion 401 is arranged on the axis L passing through the deepest portion 402 and perpendicular to the inserting direction AR3 in the above embodiment, it may not necessarily be arranged on the axis L and may be arranged on a side closer to the free end part than the center position in the inserting direction AR3.

Further, although the first and second path parts 41, 42 face each other while being inclined at the equal angle with respect to the inserting direction AR3 in the opposite directions in the above embodiment, the respective path parts 41, 42 may not necessarily be formed to have such shapes. For example, the angle between the first path part 41 and the inserting direction AR3 and the angle between the second path part 42 and the inserting direction AR3 may be different.

Further, although the main body side connector 1 is mounted on the end part of the wiring harness and the mating side connector 2 is mounted on the vehicle device in the above embodiment, the main body side connector 1 is mounted on the vehicle device and the mating side connector 2 is mounted on the end part of the wiring harness.

Note that the components described in the embodiment and respective modifications can be appropriately combined unless they contradict with each other.

Although this invention has been described in detail above, the above description is illustrative in all aspects and this invention is not limited thereto. It should be appreciated that unillustrated numerous modifications can be assumed without departing from the scope of this invention.

The invention claimed is:

1. A lever-type connector, comprising:

a main body side housing to which a mating side connector is connectable from a front end surface toward a rear end surface of the main body side housing and which is formed with a lever accommodation space extending in a direction perpendicular to a connecting direction, in which the mating side connector is connected, and forming an opening on a side end surface;

a slide lever which is a long plate-like member, inserted into the lever accommodation space through the opening with one longitudinal end thereof as a leading end part in the lead and arranged to be movable back and forth along an extending direction of the lever accommodation space;

wherein:

the slide lever includes a cam groove engageable with a cam pin projecting on the mating side connector; and the cam groove includes an open end portion open on an end surface of the slide lever extending in an inserting direction of the slide lever, a first path part connected to the open end portion and extending toward the leading end part with distance from the end surface, and a second path part extending away from the leading end part with distance from the end surface and connected to a deepest portion of the cam groove and the slide lever further includes a return preventing portion capable of coming into contact with the cam pin so that the cam pin does not move back from the second path part to the first path part while allowing the cam pin to enter the second path part from the first path part.

2. The lever-type connector according to claim 1, wherein:

the open end portion of the cam groove is arranged on an axis passing through the deepest portion and perpendicular to the inserting direction.

3. The lever-type connector according to claim 1, wherein:

the first and second path parts face each other while being inclined at an equal angle with respect to the inserting direction in the opposite directions.

* * * * *